US005249788A

United States Patent [19]

Helmstädter

[11] Patent Number: 5,249,788

[45] Date of Patent: Oct. 5, 1993

[54] SHEET STACK PRE-FEEDER

[75] Inventor: Maximilian Helmstädter, Villingen, Fed. Rep. of Germany

[73] Assignee: Mathias Bäuerle GmbH, Georgen, Fed. Rep. of Germany

[21] Appl. No.: 933,998

[22] Filed: Aug. 21, 1992

[30] Foreign Application Priority Data

Aug. 23, 1991 [DE] Fed. Rep. of Germany ..... 9110473

[51] Int. Cl.[5] ..... B65H 5/00

[52] U.S. Cl. ..... 271/10; 271/34; 271/150; 271/153; 271/155

[58] Field of Search ..... 271/10, 34, 94, 150, 271/153, 155

[56] References Cited

U.S. PATENT DOCUMENTS 2,715,975 8/1955 Doane et al. ..... 271/10
3,894,732 7/1975 Muller ..... 271/10

FOREIGN PATENT DOCUMENTS 806139 6/1951 Fed. Rep. of Germany .
2029276 2/1971 Fed. Rep. of Germany .
2342615 3/1974 Fed. Rep. of Germany .
2628338 7/1980 Fed. Rep. of Germany .
3403314A1 8/1984 Fed. Rep. of Germany .
3902297 8/1990 Fed. Rep. of Germany .
285539 11/1989 Japan ..... 271/150
670441A5 6/1989 Switzerland .

*Primary Examiner*—H. Grant Skaggs
*Attorney, Agent, or Firm*—McGlew and Tuttle

[57] ABSTRACT

The device for feeding sheet stacks 26 has a guiding device 5, in which a plurality of endless guide belts 18, 19, which guide the sheet stack 26 to a motor-driven sheet feed device 8 arranged on a removal side of the sheet stack. The endless guide belts 18 are arranged in an essentially horizontal stack support surface 4. The essentially vertical, stack-side feed sections of the feed conveyer belts 35 of the sheet feed device 8 are subdivided by articulated rollers 38 of a horizontal articulated shaft 39 arranged in the upper third of the sheet stack 26 into a lower decollation section 33, which is sloped by more than 5° and less than 30° relative to the vertical line, and an upper, more highly sloped feed section 34. To achieve reliable decollation of sheets even in the case of sheets of paper carrying high electrostatic charge, an intermittent drive 75 is provided, which drives the sheet 26' lying on the decollation sections 33 of the feed conveyer belts 35 with pulse-like acceleration steps. In addition to or instead of this, the articulated rollers 38 may be eccentrically mounted on the articulated shaft 39 to cause the sheet stack 26 in contact with them to vibrate during rotation.

20 Claims, 7 Drawing Sheets 55
54
48
10
52
53
1
51
50
50
48
9
32
12
7'
6
8
7
13
5
3
27
14
15
16
4
17
11
2

SHEET STACK PRE-FEEDER

FIELD OF THE INVENTION

The present invention pertains to a device for feeding sheet stacks with a guiding device and in particular to a feeder which has an essentially horizontal stack support surface and which guides the sheet stack stepwise to a motor-driven sheet feed device.

BACKGROUND OF THE INVENTION

In a similar prior-art device of this class as described in West German Offenlegungsschrift (Laid-open Document) DE-OS 2,342,615, which serves to convert a stack of paper sheets into a continuous-type stream, an essentially vertical, oscillatingly suspended gripper belt, which is joined by a feed section at the top, is arranged in the end zone of the guiding device rising obliquely in the direction of feed for the sheet stack. The support element of this gripper belt consists of a plurality of plate pairs, which are connected to one another by shafts in the manner of a plate link articulated chain. A pressing belt is also in spring-mounted contact with the beginning of the feed section and forms, with the gripper belt, a wedge-shaped intake for the paper sheet pulled off from the stack. The pressing belt is in spring-mounted contact with the upper end of the gripper belt. Because of the oblique position of the support surface of the guiding device and the oblique setting of the sheets of the stack, which is sloped away from the gripper belt, it is achieved that the oscillatingly suspended gripper belt is pressed against the front side of the stack and is kept in frictionally engaged connection with the foremost sheet due to the force component of its own weight, which extends in parallel to the plane of the stack. However, because of this oblique position of the stack plane, it is also necessary to arrange a support, which is connected to the conveyer belt and by which the replenishing of sheets is made difficult, on the rear side of the stack.

A similar device for decollating sheets of paperboard, cardboard, sheet metal, or the like, from a stack is also known from West German patent No. DE-PS 806,139. In this document the sheets removed from the stack can be fed into a further processing machine. The sheets stand, slightly sloped in the forward position, on a link belt moving in the forward direction in an oblique plane with periodic strokes. To decollate the sheets, a picker device consisting of controlled suction nozzles is arranged in front of the front side of the stack, which moves the sheets one by one in the upward direction and transfers them to a guide web arranged above the stack. By the guide web, the sheets are brought into the horizontal direction and transferred to the processing machine. Adjacent the suction nozzles, the picker device has a plurality of registering straps. These registering straps are arranged movably in the upward and downward directions in the decollation plane and are provided with adjustable carriers. The adjustable carriers support the suction nozzles during the upward movement of the actually foremost sheet by ripping under the actually foremost sheet. A horizontal, rotatable roller, around which the upper section of the actually foremost sheet is bent downward and thus detached from the stack by the suction nozzles, which are arranged above the said roller and are movable both horizontally and in the upward and downward directions, is arranged tangentially to the decollation plane of the picker device above the registering straps in the upper half of the stack height. To support this detachment, blow nozzles are also provided in the upper area of the stack. Aside from the fact that the design of such a device is complicated and expensive, it is not possible to achieve a high feed capacity with it.

Another prior-art feed device for sheet-like parts is described in CH 670,441 A5 and is provided with a horizontal feed conveyer for receiving a sheet stack. At the feed end of the sheet stack a lifting device is located, which consists of at least two conveyer belts arranged relative to one another and guided such that, located next to each other over some sections, they form an upwardly directed feed section and a horizontal feed section for individual sheets. To achieve reliable decollation of sheets and upward feed, a suction device and holders are present, by which the actually foremost sheet is held on the upwardly feeding section of one of the conveyer belts in a frictionally engaged manner. This device also has a complicated design and is unsuitable for reliable decollation of sheets at high work capacity.

Further devices of a similar type, but which differ markedly from the subject of the present application, are the subjects of the following documents: German Patents DE 34,03,314 A1, DE 39,02,297 A1, West German Offenlegungsschrift (Laid-open Document) DE-OS 20,29,276, and West German Auslegeschrift No. DE-AS 26,28,338.

The sheet stacks to be processed with such devices of this class are often those which had passed through another machine, e.g., a copying machine, in which they had received an above-average, high electrostatic charge, and are therefore difficult to decollate, i.e., to separate from one another.

SUMMARY AND OBJECTS OF THE INVENTION

The basic task of the present invention is to provide an efficient device of this type, of the simplest possible design, which makes it possible to easily refill relatively large sheet stacks and to arrange them on the stack support surface such that the stack weight will not exert any disturbing effect on the sheet feed device, especially in terms of the formation of a continuous, continuous-type sheet feed stream. Also it is a task of the present invention to guarantee that the sheets of the sheet stack will be reliably decollated into a continuous stream even at high work speeds and in the case of sheet stacks with high electrostatic charge.

This task is accomplished according to the present invention by the sheet feed device. The sheet feed device is arranged on the removal side of the sheet stack, and continuously removes sheets from the sheet stack by means of one or more essentially vertically extending feed conveyer belts. The sheet feed device then feeds the sheets through a deflecting device to a horizontal transport device having the guiding device. The guiding device consists of one or more endless guide belts located, with a respective winding compartment, in the plane of the stack support surface. On these guide belts the sheets of the sheet stack lie with the sheet edge at right angles to the guiding direction.

The sheet feed device has at last one endless feed conveyor belt which is guided over a drive roller of a drive shaft arranged above the sheet stack and over a lower decollating deflecting roller arranged close to the guiding device. A stack-side section of the feed conveyor being subdivided by an articulated roller arranged in the upper third of the sheet stack. The stack-side section having an essentially vertically extending, lower decollating section, which is sloped by more than 5° and less than 30° in relation to the vertical direction, and with which the sheet stack is in frictionally engaged contact on a removal side of the stack.

Movement of the feed conveyor brings about a continuous-type sheet feed leading upward to a deflecting device, and into an upper, more highly sloped feed section. The movement is by an intermittent drive means which drives the sheet actually in contact with the decollating section of the feed conveyor belt with pulse-like acceleration steps. The timing frequency shall be at least 5 Hz.

The principal advantage of this device is that it guarantees reliable decollation of sheets without the expense involved in blow and suction nozzles. The present invention brings about a fanning out of the sections of the foremost sheets of the stack extending above the articulated rollers. This fanning-out facilitates the decollation of sheets and may already be sufficient in the case of sheets that adhere together only slightly. However, due to the additionally provided measure of an intermittent drive of the feed conveyor belts with pulse-like acceleration steps, even sheets that strongly adhere to one another can be separated from the sheet stack one by one and be converted into a continuous-type stream.

The position of the articulated roller or rollers is adjustable causing it to be possible to bring the articulated rollers into the actually most favorable position in the case of different paper grades.

A plurality of advantageous possibilities for producing the pulse-like acceleration steps for the feed conveyer belts are possible. These possibilities include a Geneva motion means for producing a Geneva motion, a stepping motor, a shift transmission means with an output shaft that can be switched from continuous rotation to intermittent rotation, an overrunning clutch with an additional faster motor, an overrunning clutch with a stepping motor and an overrunning clutch with a shift transmission means.

Substantially more intense fanning out and consequently easier decollation of the sheets of the sheet stack can be achieved by producing a vibrating movement of the articulated rollers. Beginning from a defined frequency, the effect of a periodic interruption of drive or pulse-like acceleration steps will also occur, without an intermittent drive being provided for the feed conveyer belts.

It is possible, in principle, within the framework of this alternative solution, to rotatably mount the articulated rollers driven by the feed conveyer belts by means of eccentric bearing bores on the articulated shaft in order to achieve the said vibration effect. Another embodiment of the present invention has the advantage that the vibration frequency of the articulated rollers can be set optimally, regardless of their respective speed of rotation, which is determined by the work speed. This is done by having the articulating roller rotate on a cam surface of the articulating shaft. The cam surface is eccentric with a center of the articulating shaft and rotation of the articulating shaft oscillates the articulating rollers at the frequency of the shaft.

A scanning device can be used to sense if more than one sheet is being removed at a time and then used to control either the intermittent drive or the oscillating of the articulated rollers. Another scanning device could be used to move the stack against the feed conveyer in step-like movements to further help separate the sheets.

The device according to the present invention is a sheet stack pre-feeder, whose advantages are especially that practically any desired amount of paper sheets, i.e., sheet stacks of any desired size, can be placed on a stack support surface such that simple refilling is possible on the feed side located opposite the removal side, on the one hand, and that, on the other hand, the weight of the stack is absorbed by the stack support surface such that a pressing force, with which the paper stack or the "lowermost" sheet lies on the conveyer belts, is, on the one hand, sufficient to guarantee carrying in the decollated state, but, on the other hand, cannot reach a disturbing excessive value even in large stacks, is generated only by the small weight component formed due of the oblique position of the conveyor belts.

The most essential difference from the prior-art sheet stack pre-feeders is the fact that the sheet stack does not lie on the stack support surface with a flat side of the removal-side sheet, but the sheets of the stack lie on the stack support surface with a sheet edge extending at right angles to the guiding device, and that refilling of the stack is correspondingly performed on the rear side of the stack, rather than from the top.

Reliable and trouble-free guiding of the sheet stack can be guaranteed and the last sheets on the refilling side can be prevented from slipping off the stack by the use of a guide plate.

The embodiment of the feed section being at a different angle from decollating section helps both the decollation of sheets and continuous-type stream formation, because the sheet stack is slightly fanned out in the upper area located above the feed sections of the feed conveyor belts.

An embodiment using deceleration rollers after the feed conveyor guarantees the continuous formation of a continuous-type stream of sheets, which can be processed trouble-free by a sheet decollating device.

Reliable guiding of the guide belts and feed conveyor belts is achieved by the positioning the guide belts and feed conveyer in grooves or slots.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
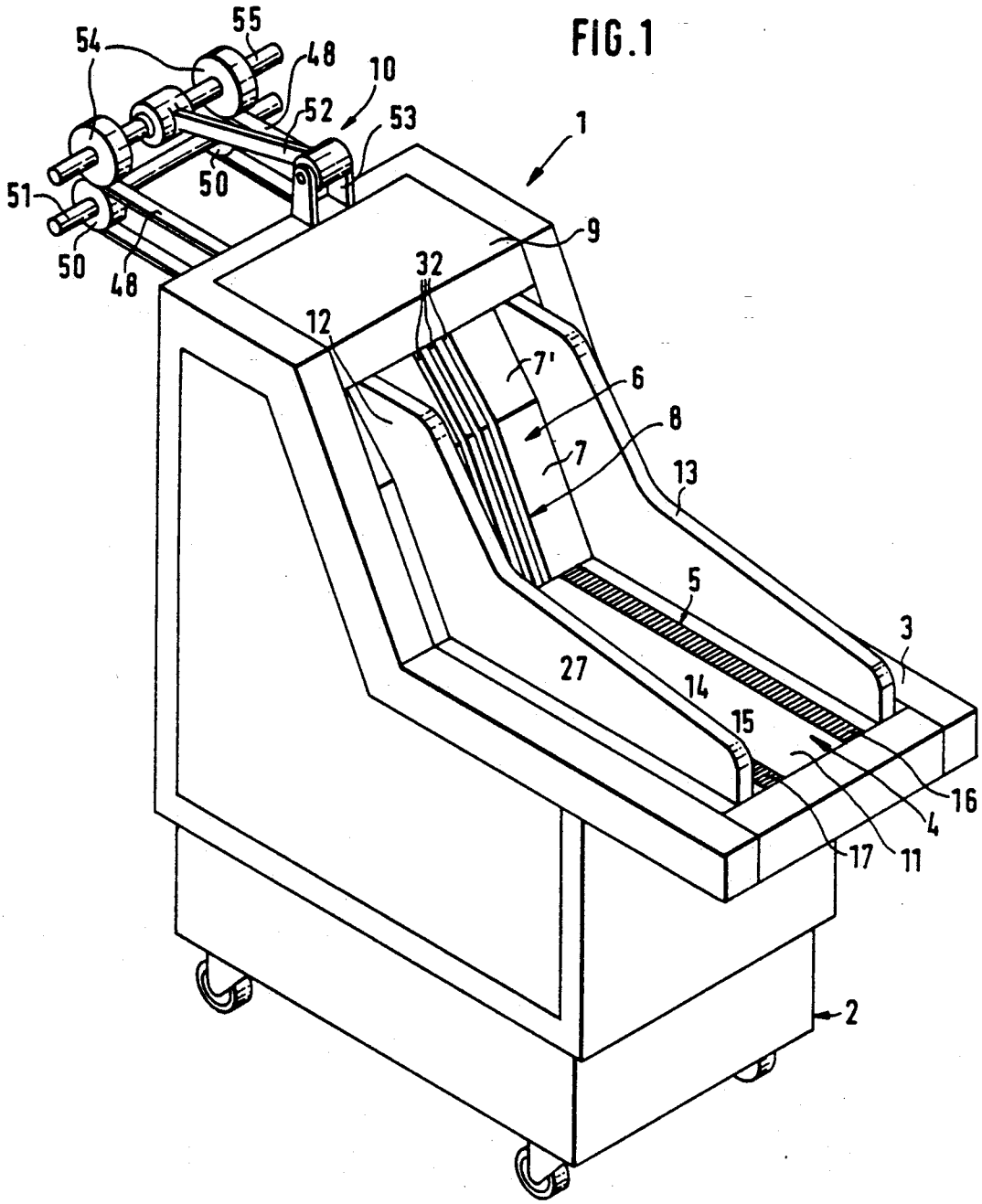
FIG. 1 is a synoptic perspective view of a sheet stack pre-feeder.

The sheet stack pre-feeder 1 shown in FIG. 1 in a perspective representation has a box-like, movable base 2, which is provided with a stack support including a stack support surface 4 and a guiding device 5 at approximately half height in a horizontal frame 3. A guide wall 6 extends obliquely in the upward direction and has two sections 7 and 7' with different slopes. In this guide wall 6 there is a sheet feed device 8, which has at its upper end, a deflecting device 9, and to which a transport device 10 is connected.

The stack support surface 4 is formed by a horizontal, flat table plate 11, which has, between two parallel guide walls 12, 13, two slots, 14, 15, which extend in parallel to one another and to the guide walls 12, 13. These slots 14, 15 have a distance of less than 17 cm from one another. The upper strands 16 and 17 of two endless guide belts 18, 19 of the guiding device 5, run, and are tensioned, over the drive rollers 20 or 21 of a motor-driven drive shaft 22, on the one hand, and over deflecting rollers 23 or 24 of a deflecting shaft 25. The upper strands are guided in the slots 14, 15. The outer sides of the guide belts 18, 19 are provided with cross grooves or tooth profiles to guarantee reliable carrying of the sheet stack 26. These sheets lie on the guide belts 18 and 19 with their lower sheet edge extending at substantially right angles to the direction of the guiding device indicated by the arrow 27, in order to bring about a positive-locking engagement. The profiling provided on the outer side of the guide belts 18 and 19 also ensures that the very last sheets 26' of the sheet stack 26 cannot slip away to the rear.

In addition, it is also possible to loosely place a feeding plate made of metal or plastic, which also engages the guide belt, on the last sheet, i.e., on the rear side 56 of the sheet stack. It would thus be possible to even more reliably prevent the rearmost sheets 26' of the sheet stack 26 from slipping away. In addition, such a feeding plate also would have the advantage that the last sheet of a stack would be gripped by the feed conveyer belts 35 with certainty, i.e., the stack would be able to be completely processed.

Most of the weight of the sheet stack is absorbed by the stack support surface 4. The guide walls 12 and 13 serve to laterally guide the sheet stack 26. They are adjustable together laterally relative to one another in the usual manner.

The guiding device 5 includes an electric motor 22/1 driving the drive shaft 22, and is controlled by a scanning device 31, which is arranged at the end of the feed section formed by the upper strands 16, 17 of the two guide belts 18 and 19. The scanning device 31 consists of an electric switch 29 with a feeler 30, which projects from the lower, less highly sloped section 7 of the guide wall 6 immediately above the stack support surface 4. The scanning device 31 is arranged such that it will switch on the guiding device 5 each time the sheet stack 26 has moved away from the guide wall 6 by a predefined minimum distance in this area. The sheet stack has moved away by this minimum distance due to the continuous removal of sheets. The scanning device 31 will again switch off the electric motor 22/1 of the guiding device 5 as soon as the sheet stack is again moved to the guide wall 6 in this lower area.

Figure 2:
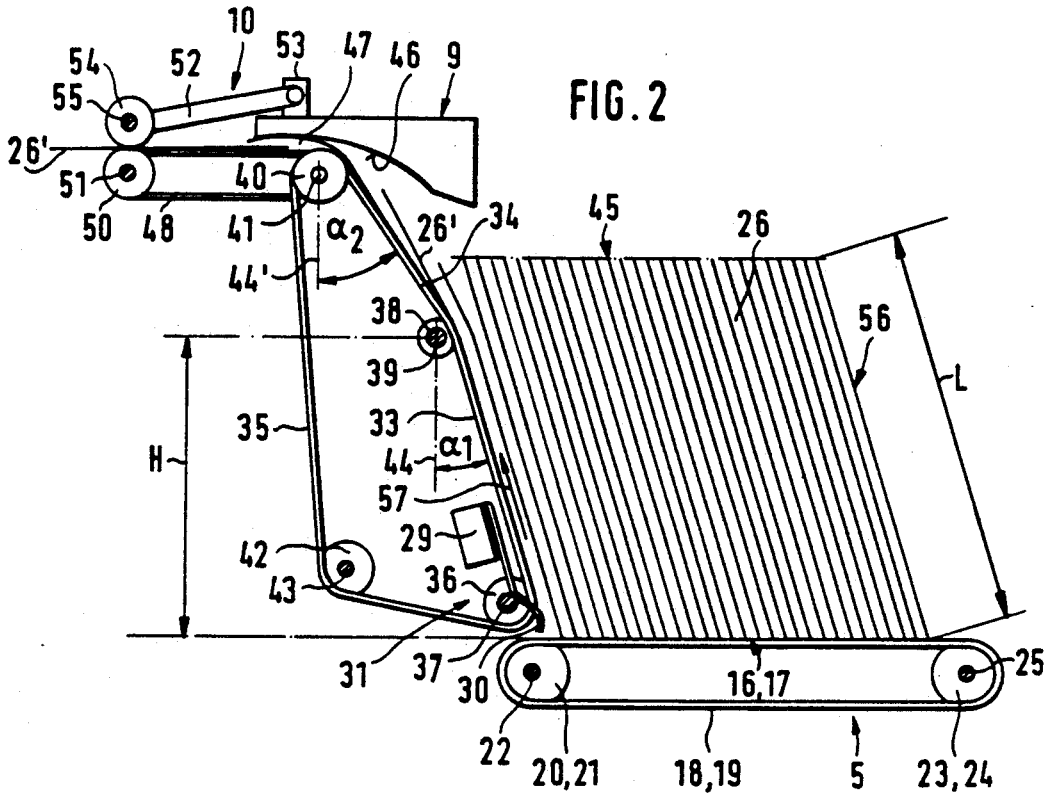
FIG. 2 is a simplified side view of the schematic design of the sheet stack pre-feeder.

Respective decollating sections 33 and feed sections 34 of three endless feed conveyer belts 35 are guided over lower decollating deflecting rollers 36 of a deflecting shaft 37. These decollating deflecting rollers 36 are arranged at the end of the guiding device 5. These three endless feed conveyer belts 35 are also guided over articulated rollers 38 of an articulated shaft 39, over drive rollers 40 of a drive shaft 41, and over deflecting rollers 42 of another deflecting roller 43, and extend in three vertically extending slots 32 of the oblique guide wall 6. The decollating deflecting shaft 37 with the decollating deflecting rollers 36 is arranged directly above the drive shaft 22 of the guiding device 5. The articulated shaft 39 with the articulated rollers 38 is arranged below the upper edge 45 of the sheet stack 26 at a height H above the stack support surface 4, which corresponds to about three fourths of the vertical sheet length L. In addition, the articulated shaft 39 is offset relative to the decollating deflecting roller 37 such that the decollating sections 33 of the feed conveyer belts 35 form with the vertical line 44 a slope angle $\alpha 1$, which is approximately 15°. The drive shaft 41, on which the drive rollers 40 are mounted freely rotatably, is arranged at approximately double the height H above the stack support surface 4 and is offset relative to the articulated shaft 39 to the extent that the feed sections 34 of the feed conveyer belts 35 form a second, larger slope angle $\alpha 2$ of about 35° with the vertical line 44', as shown in FIG. 2.

The decollating sections 33 and the feed sections 34 consequently have different slopes in relation to the vertical lines 44 and 44', respectively, so that a bend occurs in the sheet stack 26. By this bend a section of the sheet stack 26 located above the articulated shaft 39 is continuously fanned out in the vicinity of the guide wall 6. This greatly facilitates the continuous decollation of sheets formed at the feed conveyer belts 35 in the area of the articulated shaft 39.

The feed conveyer belts, driven in the direction of the arrow 57, have a high coefficient of friction on at least their outer surfaces, which come into contact with the sheets of the sheet stack 26 which are in contact with the section 7 of the guide wall 6. This causes reliable, frictionally engaged carrying of the individual sheets 26' and consequently reliable decollation of the sheets take place. The individual sheets 26' of the sheet stack 26 are guided upward against the arched deflecting surface 46 of the deflecting device 9 and from here the individual sheets are guided through a guide gap 47 of the transport device 10.

The sections 7 and 7' of the guide wall 6 are also sloped relative to the vertical lines 44 and 44' by the respective angles of $\alpha 1$ and $\alpha 2$ and extend, with a slight offset, practically in the plane of the decollation sections 33 and of the feed conveyer belt sections 34. The individual sheets 26' of the sheet stack 26 are able to consecutively come into a frictionally engaged connection with these decollation sections 33 of the feed conveyer belts 35 in order to thus enter individually the transport device through the deflecting device 9 and to be then gripped by this transport device 10.

The transport device 10 consists of two horizontal conveyer belts 48, which are driven by two drive rollers 49 rigidly mounted on the drive shaft 41 at a lower feed speed than are the feed conveyer belts 35. These conveyer belts 48 also run over deflecting rollers 50 of a deflecting shaft 51. Decelerating rollers 54, which lie on the conveyer belts 48 in the area of the deflecting rollers 50 and serve to form an ordered continuous stream. This ordered continuous stream is led by means of the transport device 10 to a sheet decollation device of a processing station, not shown, e.g., a folding machine. The decelerating rollers 54 are arranged on a horizontal shaft 55 on a pivoted lever 52, which is hinged to a bearing block 53 on the top side of the deflecting device 9.

Whether the sheet feeding device 8 and the transport device 10 are operated in continuous operation or intermittently depends on the work speed of the processing station that is preceded by the sheet stack pre-feeder 1.

In the above-described sheet stack pre-feeder 1, such a large portion of the stack weight of the paper stack 26 is absorbed by the stack support surface 4 that maximum stack size depends only on the horizontal length of the stack support surface 4, and is unable to interfere with the paper decollation process, which is brought about by the feed conveyer belts 35 in the area of the decollation sections 33. On the other hand, the slope provided for the decollation sections 33 of the feed conveyer belts 35 by the slope angle $\alpha 1$ of about 15° ensures that the sheets 26' which are actually the foremost sheets on the removal side will come to lie against the decollation sections 33 of the feed conveyer belts 35, and with a contact pressure that is sufficient to guarantee trouble-free decollation of sheets.

While it would also be conceivable, in principle, to drive the guide belts 18 and 19 at a low guiding speed continuously, the intermittent guiding of the sheet stack 26 to the decollation sections 33 of the feed conveyer belts 35, which is provided for practice, causes the very foremost sheet 26' of the sheet stack 26 not to come to lie over its entire length against the decollation sections 33 of the feed conveyer belts 35, but to lie, at least temporarily, only in the area of the articulated rollers 38. However, this does not have any disadvantageous effect on the decollation process.

Due to the articulated shaft 39 being arranged below the top edge 45 approximately in the middle of the upper half of the sheet stack 26, the very next sheet 26' of the sheet stack 26 is carried even before the preceding sheet 26' has left the upper section of the sheet stack 26, so that a continuous overlap of the sheets 26' being fed is achieved. It is also possible to select or adjust the scanning device 31 such that the sheet stack will be guided at short time intervals and at short distances, and the slope of the sheet stack will deviate, in the extreme case, only slightly from the slope of the decollation sections 33 of the feed conveyer belts 35.

It is also important to make the mounting of the articulated shaft 39 adjustable in height, so that the position of the articulated shaft 39 consequently also the slope of the decollation sections 33 can be correspondingly adapted to different paper grades or sheet length L in order to achieve optimal fanning out of the topmost section of the sheet stack, on the one hand, and optimal frictional conditions and decollation results, on the other hand.

Since the sheet stack is refilled on the rear side 56 of the stack in the device described here, it can be carried out not only in a simple manner, but also without any impairment of the decollation process and practically even without any weight limitation.

Figure 8:
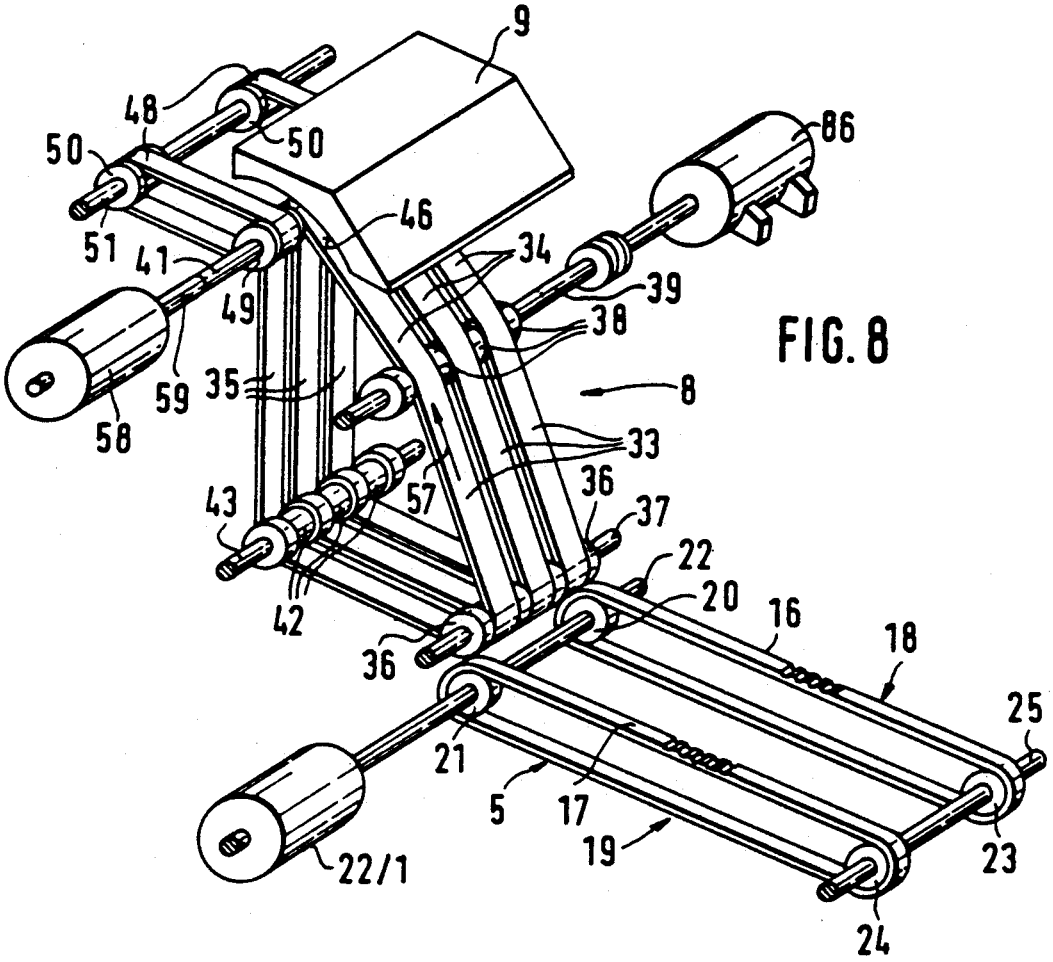
FIG. 8 is the arrangement according to FIG. 3 with a continuous feed conveyor belt drive and another embodiment of the articulated shaft.

While it is possible, in principle, and also sufficient for the normal case, to drive the drive shaft 41, and consequently the feed conveyer belts 35 as well, by means of a continuously running electric motor 59 (FIG. 8), there will be described below various embodiments of different drive means for the drive shaft 41, and measures which guarantee dependable and reliable decollation of sheets even if the individual sheets 26' of the sheet stack 26 strongly adhere to one another, e.g., due to increased electrostatic charge, and therefore they cannot be decollated by a normal, continuous drive of the feed conveyer belts 35 with the necessary reliability.

According to one of the measures suggested according to the present invention, the feed conveyer belts 35 are not driven continuously, but, at least when needed, intermittently, with pulse-like acceleration steps. The feed conveyer belts then perform jerky feed movements in order to thus separate the sheet of the sheet stack in contact with the feed sections 33 as a separate sheet and to feed it in the upward direction.

According to another possibility, which can, however, also be used in addition to the first measure, intensified fanning out of the sheet stack section that is actually located above the articulated shaft 39 is achieved by mounting the articulated rollers 38 eccentrically on the articulated shaft 39, so that they exert a vibrating movement on the sheet stack due to their rotation or the rotation of the articulated shaft 39.

Several possibilities for generating pulse-like acceleration steps of the feed conveyer belts 35 will be described below.

Figure 3:
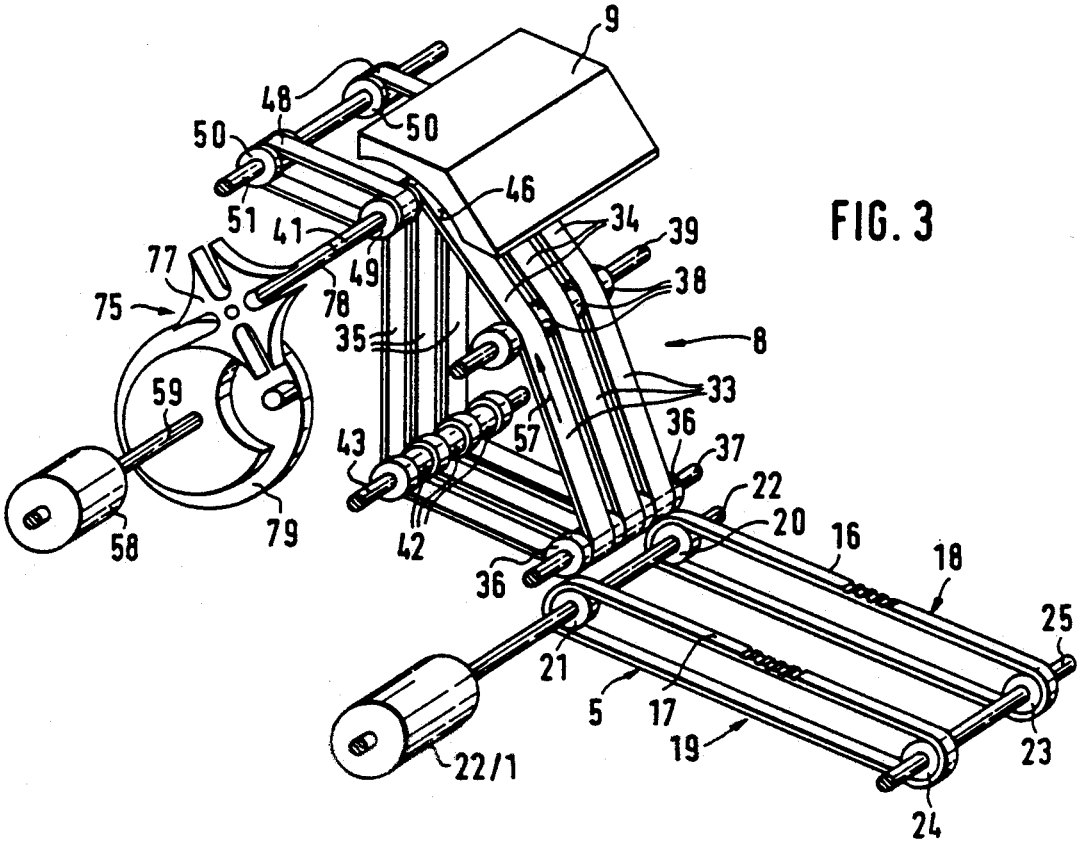
FIG. 3 is a simplified perspective representation of the arrangement of the feed means of the guiding device, the sheet feed device, and the transport device with a first embodiment of the feed conveyor belt drive.

For example, in FIG. 3, a Geneva motion means 75 is provided, which converts the uniform rotary movement of a motor shaft 76 of an electric motor 58 into stepped movements, and transmits these stepped movements onto the drive shaft 41 and consequently to the feed conveyer belts 35. The shaft 78 of the star plate 77 is directly connected to the drive shaft 41, while the switching disk 79 of the Geneva motion means 75 is directly mounted on the motor shaft 76.

It is, of course, also possible to arrange another step-down gear after the Geneva motion 75.

Figure 4:
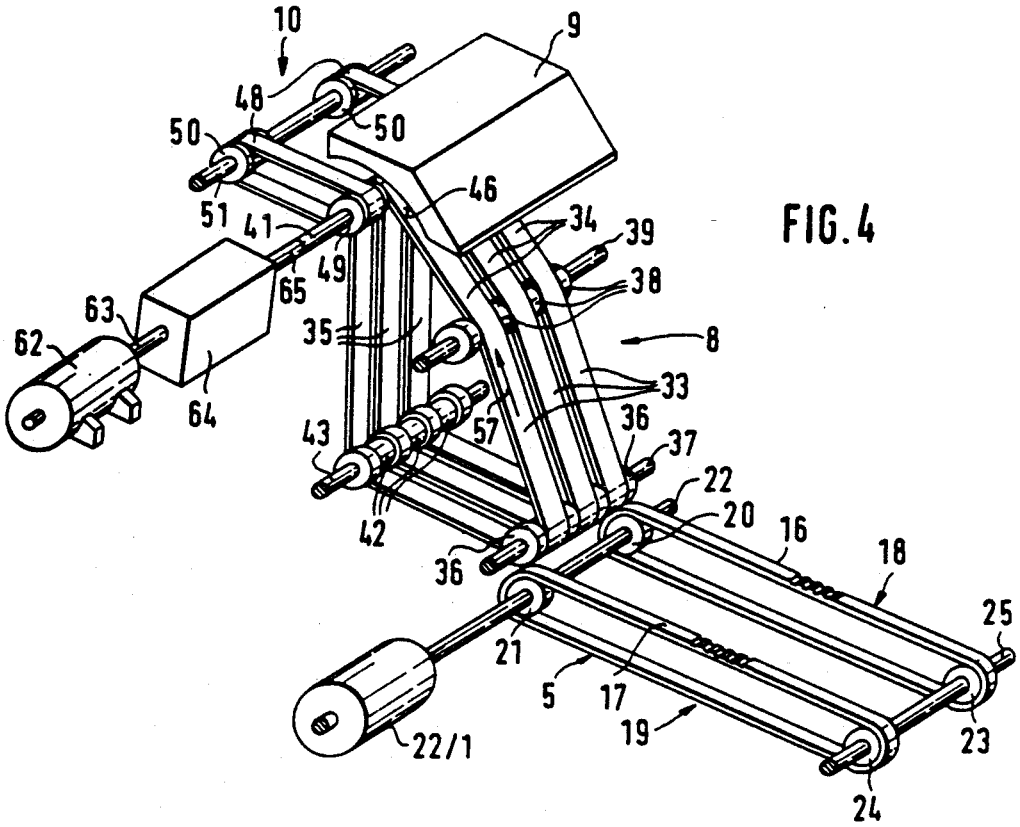
FIG. 4 is the arrangement according to FIG. 3 with a second embodiment of the feed conveyor belt drive.

In the embodiment of an intermittent drive of the drive shaft 41 as shown in FIG. 4, a stepping motor 62 has a motor shaft 63 connected via a gear mechanism and a gear shaft to the drive shaft 41. However, it would also be possible, in principle, to directly couple the motor shaft 63 to the drive shaft 41. However, the provision of the gear mechanism 64 offers the advantage that the acceleration characteristic of the acceleration steps, which are generated by the stepping motor 62 on the drive shaft 41 and consequently on the feed conveyer belts 35, can be varied within certain limits and can therefore be optimally adapted to the actual needs.

Figure 5:
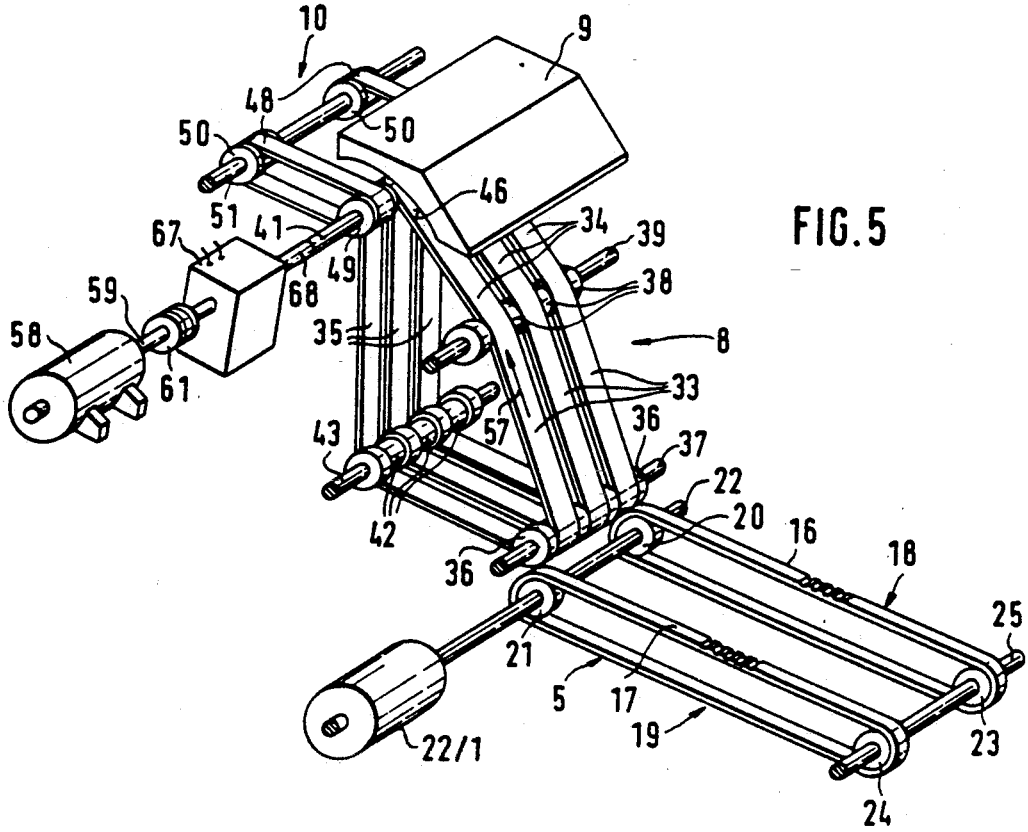
FIG. 5 is the arrangement according to FIG. 3 with a third embodiment of the feed conveyor belt drive.
Figure 11:
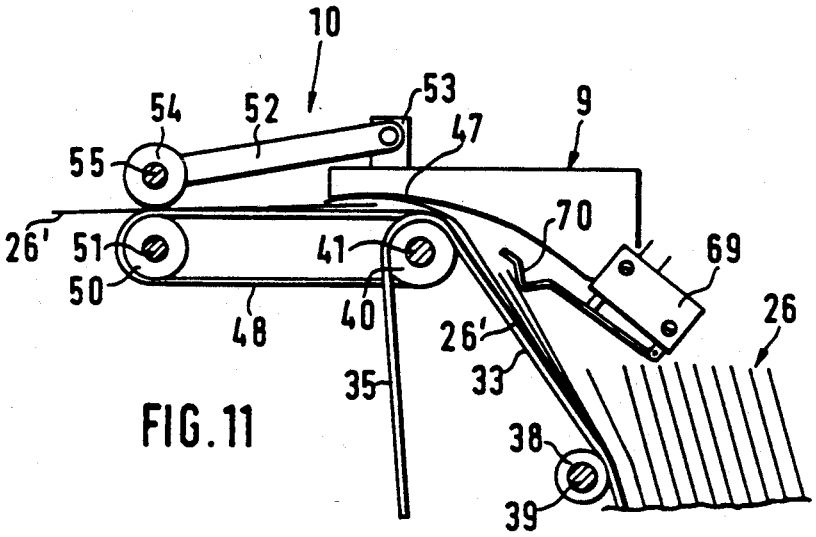
FIG. 11 is the arrangement of a sheet sensor in the area of the more highly sloped upper feed section.
Figure 15:
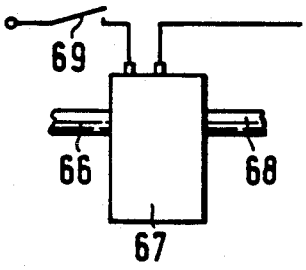

In the embodiment according to FIG. 5, the uniformly rotating motor shaft 59 of the electric motor 58 is connected via a clutch 61 to the input shaft 66 of a shift transmission 67, which can be switched over electrically from uniform operation to intermittent operation, and whose output shaft 68 is connected to the drive shaft 41. The shift transmission 67 is controlled by an electric tactile sensor 69 (FIG. 11), which is arranged in the area of the feed sections 34 of the feed conveyer belts 35 below the deflecting device 9. The tactile sensor 69 includes an electric switch 69' electrically connected to the shift transmission 67 in the manner shown schematically in FIG. 15. The tactile sensor 69 is arranged and adjusted such that the switch 69' will be closed and the shift transmission 67 will be switched over from continuous power transmission to intermittent power transmission each time more than a defined number of pages or sheets 26', e.g., more than two sheets 26', arrive simultaneously at its tactile arm 70. This means that in this embodiment, the feed conveyer belts 35 are driven with pulse-like acceleration steps by means of the tactile sensor 69 only if this is indeed necessary. It is thus possible to reach a substantially higher overall feeding capacity.

Figure 6:
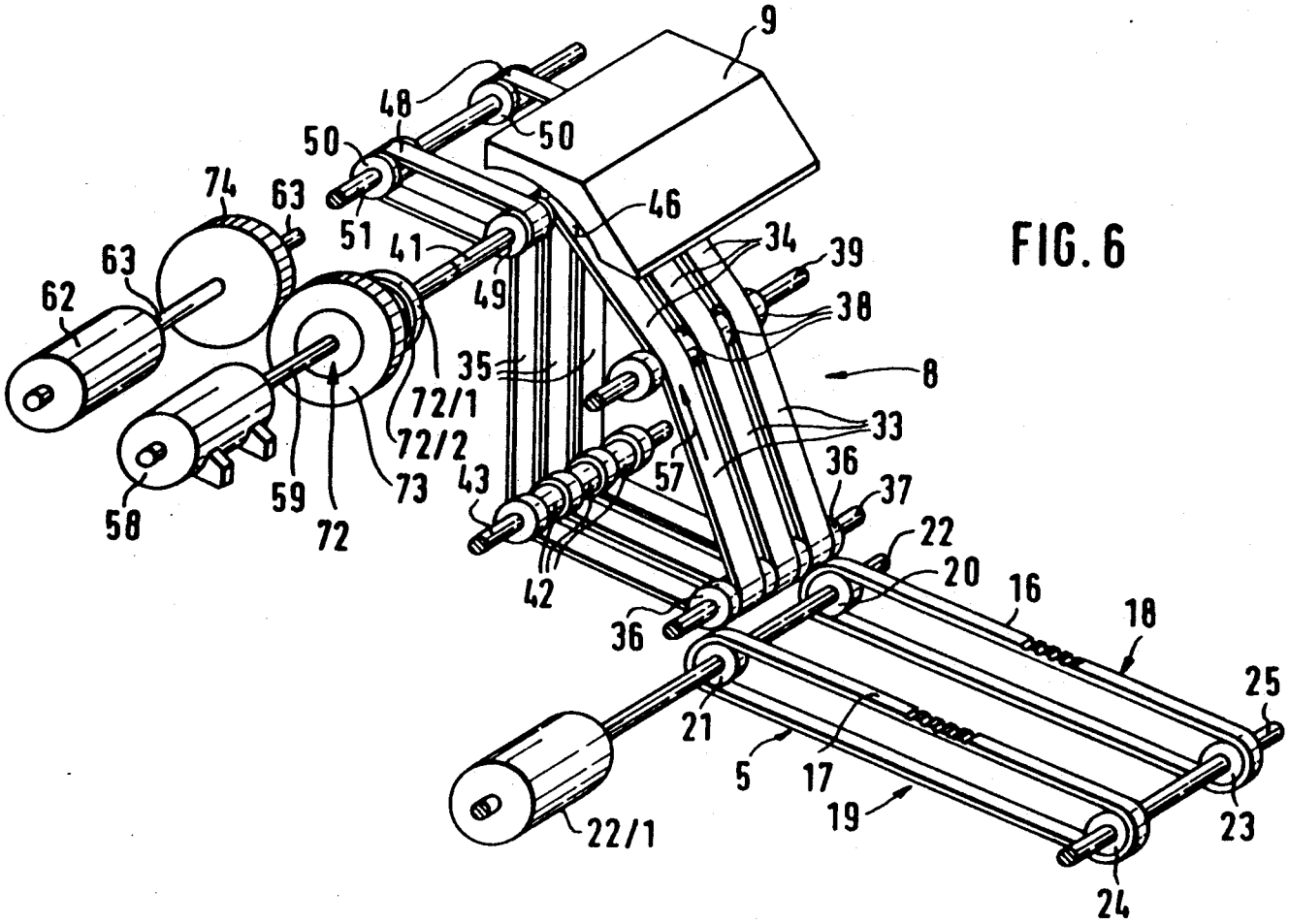
FIG. 6 is the arrangement according to FIG. 3 with a fourth embodiment of the feed conveyor belt drive.

The possibility of turning on and off the intermittent stepping drive of the drive shaft 41 and consequently of the feed conveyer belts 35 by means of the tactile sensor 69 as needed is available in the embodiment according to FIG. 6 as well. The continuously rotating electric motor 58, whose motor shaft 59 is permanently connected to the output-side overrunning part 72/1 of an overrunning or overriding clutch 72. the overrunning part 72/1 is in direct connection, via the output shaft 71, with the drive shaft 41. These elements are provided for the continuous drive of the drive shaft 41 in this embodiment as well.

Figure 13:
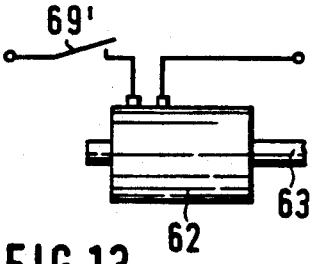

The other, input-side overrunning part 72/2 of the overrunning or overriding clutch 72 is also provided with a gear 73, which is in power-transmitting connection with the output-side clutch part 72/1 via clutch members acting in one direction of rotation only, e.g., clutch rollers or clutch balls. The gear 73 engages another gear 74, which is mounted on the motor shaft 63 of a stepping motor 62. As is schematically represented in FIG. 13, the stepping motor 62 is switched on and off by the electric switch 69' of the tactile sensor 69 in the same manner as the shift transmission 67 in the abovedescribed embodiment according to FIGS. 5 and 15. However, the stepping motor 62 is designed such that its drive steps take place at a higher angular velocity than the rotary movement of the continuously rotating motor shaft 59 of the electric motor 58. As a result, when the stepping motor 62 is turned on, a stepping drive of the drive shaft 41 is superimposed on the normal rotary movement via the overrunning or overriding clutch 72. This drive shaft 41 is then also subject to pulse-like acceleration steps, which have a substantially better sheet decollation effect.

Figure 7:
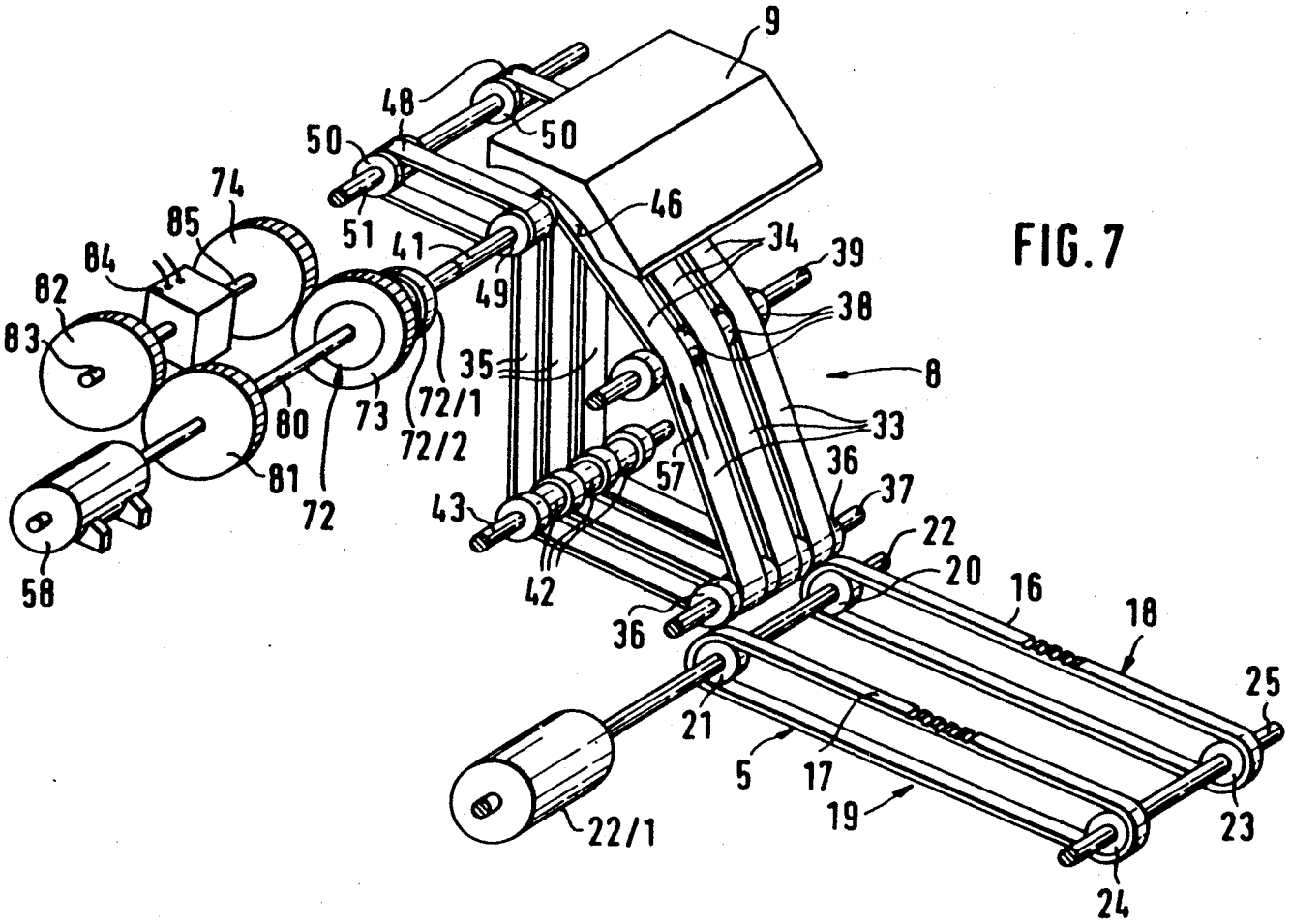
FIG. 7 is the arrangement according to FIG. 3 with a fifth embodiment of the feed conveyor belt drive.
Figure 12:
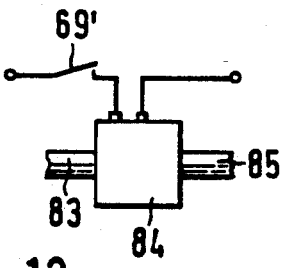
FIGS. 12 through 15 are simplified representations of different electric control circuits of the sheet sensor.

In the embodiment shown in FIGS. 7 and 12, the motor shaft 59 of the uniformly rotating electric motor 58 is connected via a connection shaft 80 with the overrunning part 72/1 of an overrunning or overriding clutch 72. The overrunning clutch 72 has an output shaft 71 directly connected to the drive shaft 41. In addition, the motor shaft 59 is in direct gear connection—via a gear 81, which engages a gear 82—with the input shaft 83 of a shift transmission 84, which is electrically controllable by the tactile sensor 69. The gear 82 is permanently attached to the input shaft 83 of the shift transmission 84. It is continuously driven by the gear 81 mounted permanently on the motor shaft 59. The shift transmission 84 is provided with an output shaft 85, which performs pulsating acceleration steps when the electric switch 69' of the switching circuit shown schematically in FIG. 12 is closed. These acceleration steps have a higher angular velocity than the normal rotary movement of the gear 81 or of the connection shaft 80. The connection shaft 80, which is directly coupled with the motor shaft 59, is directly connected to the output-side overrunning part 72/1 of the overrunning or overriding clutch 72, and whose output shaft 71 in turn is directly connected to the drive shaft 41. The gear 73 of the output-side overrunning part 72/1 of the overrunning or overriding clutch 72 is in gear connection here, via gear 74 of the output shaft 85. The pulsating acceleration steps of the output shaft 85 are transmitted via the gears 74 and 73 and the overrunning or overriding clutch 72 to cause higher angular velocities at the drive shaft 41 and consequently to the feed conveyer belts 35 as well.

The other possibility of achieving reliable decollation of sheets even with continuous drive of the feed conveyer belts 35 is shown in FIGS. 8, 9, 10, and 14. In this case, the drive shaft 41 is driven by the continuously rotating drive motor 58, whose said motor shaft 59 is directly connected to it. To achieve intensified fanning out of the sheet stack 26 during the entire duration of operation of the device, the articulated rollers 38 are mounted eccentrically on the articulated roller shaft 39 in the simpler embodiment according to FIG. 10. These articulated rollers 38 continuously exert shaking movements on the sheet stack 26 during their rotation caused by the feed conveyer belts 35. In this way the individual sheets 26' of the sheet stack 26 will be fanned out even more intensely in the front area than it is done by the bend that is located between the two sections 33 and 34.

Figure 9:
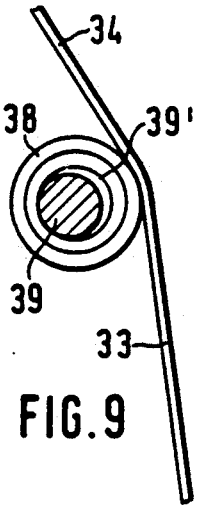
FIG. 9 is a sectional view of the articulated shaft according to FIG. 8.
Figure 10:
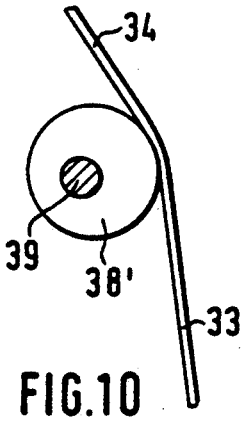
FIG. 10 is a side view of an articulated roller mounted eccentrically on the articulated shaft.

Substantially more intense and efficient fanning out of the sheet stack can also be achieved by the articulated roller shaft 39 itself being provided, according to FIG. 9, with cams 39', on which the articulated rollers 38 are mounted, and by the articulated roller 39 being driven, in addition, by means of an electric motor 86 either at a substantially higher angular velocity than are the articulated rollers 38, or in the opposite direction. This offers the possibility that the vibration frequency which is exerted by the articulated rollers 38 on the sheet stack can be optimized by varying the speed of the electric motor 86.

Figure 14:
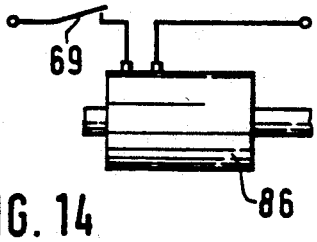

Moreover, it is possible, according to the simplified representation in FIG. 14, to switch on the electric motor 86 by means of the tactile sensor 69 only as needed, in the case of disturbance in the desired decollation of sheets.

While specific embodiments of the invention have been shown and described in detail to illustrate the application of the principles of the invention, it will be understood that the invention may be embodied otherwise without departing from such principles.

What is claimed is:

1. Device for feeding a stack of sheets, the device comprising:

a stack support including a stack support surface, said stack support surface including a first end and a second end;

guide wall means extending from said stack support surface and for containing the stack of sheets with a edge of each of the sheets being in contact with said stack support surface;

guide means positioned in said stack support surface and for moving the stack of sheets in contact with said stack support surface from said first end to said second end of said stack support surface, said guide means moving the sheets in a direction substantially perpendicular to the edge of each of the sheets and to a plane of each of said sheets;

sheet feed means positioned at said second end of said stack support surface and for individually removing a single sheet from the stack of sheets, said sheet feed means including a feed conveyer having a side substantially parallel to the single sheet and in contact with a side of the single sheet, said feed conveyer traveling around a decollating deflecting roller, said decollating deflecting roller being positioned adjacent said second end of said stack support surface, said feed conveyer also travelling around a drive roller, said drive roller being positioned at a spaced distance away from the stack and downstream of said removing of the single sheet, also said side of said conveyor travelling around an articulating roller positioned adjacent to an upper third section of the sheets of the stack, said side of said conveyer including a decollating section between said decollating deflecting roller and said articulating roller, said side of said feed conveyer also including a feed section between said drive roller and said articulating roller, said sheet feed means also including an intermittent drive means for moving said feed conveyer with pulse-like acceleration steps.

2. A device in accordance with claim 1, wherein:

said stack support surface is substantially horizontal;

said guide wall means containing the planes of the stack of sheets in a substantially vertical position;

said guide means performs said moving of the stack in a step-like manner to position the single sheet of the stack against said side of said feed conveyer, and said guide means includes a guide belt having a strand positioned in and substantially parallel to said stack support surface, said strand of the guide belt being in contact with the edges of the sheets of the stack and said guide belt moving substantially perpendicular to the edges of the sheets;

said sheet feed means also feeding said removed sheet into a deflecting device and onto a substantially horizontal transport device, said drive roller of said sheet feed means being positioned above the sheet stack, said decollation section of said feed conveyer being in a plane positioned at an angle greater than 5 degrees and less than 30 degrees from vertical and brings about a continuous sheet feed upward to said deflecting device, said feed section of said feed conveyer being more angled with respect to vertical than said decollation section, said side of said guide conveyer frictionally engaging with the single sheet to be removed, and said articulated rollers are eccentrically mounted on an articulated shaft.

3. Device in accordance with claim 2, wherein:

said feed conveyer has an outer surface facing the sheet stack and said outer surface has a high coefficient of friction with paper.

4. Device in accordance with claim 2, further comprising:

feed scanning means for switching on one of said intermittent drive and/or a motor drive of said articulated shaft when a plurality of sheets are removed by said sheet feed means from the stack, said feed scanning means being positioned in an area of said feed section.

5. Device in accordance with claim 2, wherein:

said guide belt has one of grooves and tooth profiles on an outer surface which comes into contact with the sheet stack.

6. Device in accordance with claim 2, wherein:

said substantially horizontal transport device includes deceleration rollers for continuous stream formation, said deceleration rollers being driven at a transport speed lower than that of said feed conveyer, and said substantially horizontal transport device feeds sheets removed from the sheet stack to a sheet decollation device of a processing station.

7. Device in accordance with claim 2, wherein:

said strand of said guide belt extends in one of a slot and/or groove-like depressions of a table plate forming said stack support surface.

8. Device in accordance with claim 1, wherein:

said acceleration steps have a timing frequency of at least 5 Hz.

9. Device in accordance with claim 1, wherein:

said articulated roller is adjustable in distance away from said stack support surface.

10. Device in accordance with claim 1, wherein:

said intermittent drive means includes a continuously rotating motor and Geneva motion means for converting a continuous rotation from said motor into an intermittent rotation driving said drive roller.

11. Device in accordance with one claim 1, wherein:

said intermittent drive means includes a stepping motor connected to and intermittently driving, said drive roller and said feed conveyer.

12. Device in accordance with claim 1, wherein:

said intermittent drive means includes a shift transmission means for switching said driving of said drive roller between a continuous rotation and an intermittent rotation in order to transmit power onto said drive roller in periodic acceleration steps.

13. Device in accordance with claim 1, wherein:

said intermittent drive means includes a continuously rotating motor and an overrunning clutch with an additional motor means for providing a rotation at a higher angular velocity than said continuously rotating motor.

14. Device in accordance with claim 13 wherein:

said additional motor means includes a stepping motor having a motor shaft in gear connection with an overrunning part of said overrunning clutch.

15. Device in accordance with claim 13, wherein:

said additional motor means includes an intermittently driven output shaft of a shift transmission means for switching between a continuous rotation and an intermittent rotation, said shift transmission means having an input side is in gear connection said continuously rotating motor.

16. Device in accordance with claim 1, further comprising:

guide scanning means for controlling said guiding means, said guide scanning means being positioned at an end of said feed section adjacent to said stack support surface.

17. Device in accordance with claim 1, wherein:

said decollation section and said feed section of said feed conveyer are positioned in one of slots and/or groove-like depressions of a guide wall extending in a substantially similar plane as said decollating section and said feed section.

18. Device for feeding a stack of sheets, the device comprising:

a stack support including a substantially horizontal stack support surface, said stack support surface including a first end and a second end;

guide wall means extending from said stack support surface and for containing the stack of sheets with a edge of each of the sheets being in contact with said stack support surface and the planes of the stack of sheets in a substantially vertical position;

guide means positioned in said stack support surface and for stepwise moving the stack of sheets in contact with said stack support surface from said first end to said second end of said stack support surface, said guide means moving the sheets in a direction substantially perpendicular to the edge of each of the sheets and to a plane of each of said sheets, and said guide means includes a guide belt having a strand positioned in and substantially parallel to said stack support surface, said strand of the guide belt being in contact with the edges of the sheets of the stack and said guide belt moving substantially perpendicular to the edges of the sheets;

sheet feed means positioned at said second end of said stack support surface and for individually removing a single sheet from the stack of sheets and also feeding said removed sheet into a deflecting device and onto a substantially horizontal transport device, said sheet feed means including a feed conveyer having a side substantially parallel to the single sheet and in contact with a side of the single sheet, said feed conveyer traveling around a decollating deflecting roller, said decollating deflecting roller being positioned adjacent said second end of said stack support surface, said feed conveyer also travelling around a drive roller, said drive roller being positioned at a spaced distance away from the stack, downstream of said removing of the single sheet and above the sheet stack, also said side of said conveyor travelling around an articulating roller positioned adjacent to an upper third section of the sheets of the stack, said side of said conveyer including a decollating section between said decollating deflecting roller and said articulating roller, said decollation section of said feed conveyer being in a plane positioned at an angle greater than 5 degrees and less than 30 degrees from vertical and brings about a continuous sheet feed upward to said deflecting device due to frictionally engaged contact with the single sheet, said side of said feed conveyer also including a feed section between said drive roller and said articulating roller, said feed section of said feed conveyer being more angled with respect to vertical than said decollation section, and said articulated rollers being eccentrically mounted on an articulated shaft.

19. Device in accordance with claim 18, wherein:

said articulated roller is rotatably mounted on a cam of said articulated shaft, and said articulated shaft is driven by a motor at one of a higher speed than and in a same rotational direction as said articulated roller, or in a direction opposite said rotational direction of said articulated rollers.

20. A method for feeding a stack of sheets, the method comprising the steps of:

moving the stack of sheets against a feed conveyor, said moving being in a substantially horizontal direction with the planes of the sheets being substantially vertical, and said feed conveyor having a substantially vertical surface coming into contact with the stack of sheets, said substantially vertical surface having a decollating section, and a feed section above said decollating section, an angle of said feed section being offset from said decollating section to cause the sheets to fan-out during said moving against said feed conveyor;

moving said surface of said feed conveyor substantially upwards to also move a single sheet of the stack to a position away from the stack, said moving of said surface of said feed conveyer being in pulse-like acceleration steps to cause the single sheet to break loose from frictional contact with the stack;

providing an articulating roller positioned against said surface of said feed conveyor and between said feed section and said decollating section; and oscillating said articulating roller in and out of one of a plane of said feed section and said decollating section to also cause the single sheet to break loose from frictional contact with the stack.

* * * * *